United States Patent [19]

Narita

[11] Patent Number: 4,920,468

[45] Date of Patent: Apr. 24, 1990

[54] MECHANISM FOR MOUNTING A LIGHT SOURCE AND A LAMP TILTING SECTION OF A SEARCHLIGHT

[75] Inventor: Yuichi Narita, Urawa, Japan

[73] Assignee: Sanshin Dengu Manufacturing Co., Ltd., Japan

[21] Appl. No.: 305,934

[22] Filed: Feb. 2, 1989

[30] Foreign Application Priority Data

Feb. 9, 1988 [JP] Japan ..... 63-15215[U]

[51] Int. Cl.[5] ..... F21V 19/02

[52] U.S. Cl. ..... 362/287; 362/286; 362/372; 362/418; 362/427

[58] Field of Search ..... 362/35, 372, 374, 418, 362/306, 375, 285, 286, 287, 375, 427, 428

[56] References Cited

U.S. PATENT DOCUMENTS

| | | | |
|---|---|---|---|
| 29,266 | 6/1977 | Hessemer et al. | 362/386 |
| 2,111,650 | 3/1938 | Wells et al. | 362/372 |
| 2,138,076 | 11/1938 | Taylor et al. | 362/372 |
| 2,169,627 | 8/1939 | Worden et al. | 362/374 |
| 4,065,806 | 12/1977 | Satch . | |
| 4,353,110 | 10/1982 | Ellis . | |
| 4,445,163 | 4/1984 | Ziaylek, Jr. | 362/372 |
| 4,587,602 | 5/1986 | Dean et al. | 362/375 |

*Primary Examiner*—Ira S. Lazarus
*Assistant Examiner*—D. M. Cox
*Attorney, Agent, or Firm*—Kane, Dalsimer, Sullivan, Kurucz, Levy, Eisele and Richard

[57] ABSTRACT

In a searchlight including a light source which in turn includes a lamp, a reflector and a socket, and a lamp tilting section for swinging the light source vertically within a housing of the searchlight, a mechanism for mounting the light source and the lamp tilting section includes a support frame slidingly inserted in the housing through a guide on the inner surface of the housing to support the light source and the tilting section. The support frame is removably fixed to a front opening end of the housing.

3 Claims, 3 Drawing Sheets

MECHANISM FOR MOUNTING A LIGHT SOURCE AND A LAMP TILTING SECTION OF A SEARCHLIGHT

BACKGROUND OF THE INVENTION

The present invention relates to a mechanism for fixing a light source and a lamp tilting or elevating section of a searchlight within its housing.

The searchlight includes within its housing a light source which, in turn, includes a lamp, a reflector and a socket, and a lamp tilting section which rotates the light source to thereby tilt the light beams vertically. The respective parts of the light source and lamp tilting section are mounted on the inner surface of the housing and on fixtures secured to the inner surface of the housing.

In this fixing structure, the assembling of the light source and lamp tilting section within the housing is performed by inserting the respective parts of the light source and lamp tilting section within the housing, and mounting them sequentially within the housing. In this case, the inner space of the housing is very small, the attaching operation is difficult and not efficient. In repair, the parts of the light source and lamp tilting section positioned before defective parts must be disassembled in the small housing space and removed out of the housing. For example, if the lamp tilting section fails which is likely to fail and positioned at the innermost position within the housing, all the parts within the housing must be disassembled and taken out.

It is therefore an object of the present invention to provide a mechanism which mounts a light source and a lamp tilting section of a searchlight which mechanism brings about easy assembly and disassembly of the light source and lamp tilting section.

SUMMARY OF THE INVENTION

According to the present invention, the above object is achieved by a mechanism for mounting a light source which in turn includes a lamp, a reflector and a socket, and a lamp tilting section for swinging the light source vertically, within a housing of a searchlight including the light source and the lamp tilting section, comprising:

means slidingly insertable within the housing for supporting the light source and the tilting section;

means formed in the inner surface of the housing for guiding the supporting means; and means for fixing the supporting means removably to a front opening end of the housing.

The assembly in which the light source and lamp tilting section are beforehand attached on the supporting means outside the housing is slid along the guiding means into the housing and fixed to the housing. In repair, the assembly is taken out of the housing and disassembled.

DETAILED DESCRIPTION

Figure 1:
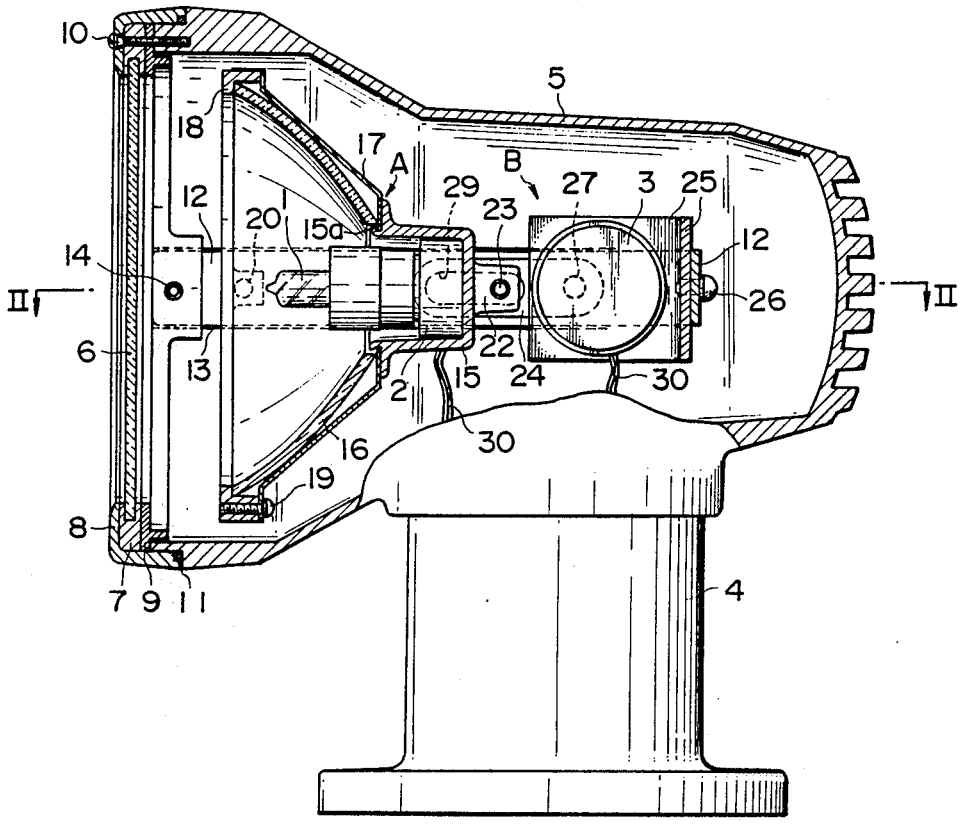
FIG. 1 is a partial elevational cross section view of a searchlight with a mechanism which attaches a light source and a lamp tilting section as an embodiment of the present invention.
Figure 2:
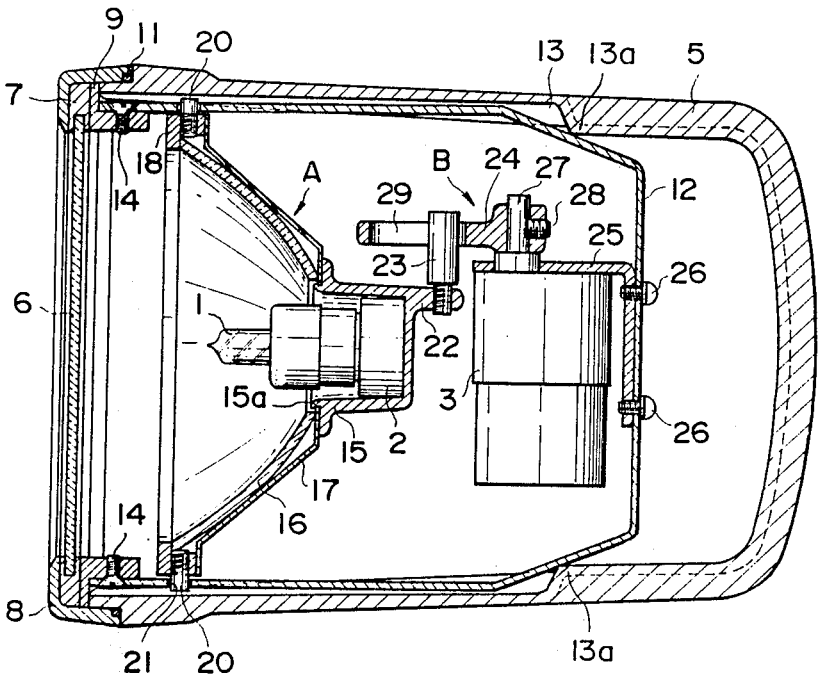
FIG. 2 is a horizontal cross section view of the searchlight taken along line II—II in FIG. 1.

An embodiment of the present invention will now be described in more detail with reference to the drawings. FIGS. 1 and 2 are a partial elevational cross section view and a partial horizontal cross section view, respectively, of a searchlight with a lamp tilting mechanism according to the present invention in which a lamp 1, a socket 2, a motor 3 and a base 4 are shown not sectioned. The base 4 is fixed to a searchlight mount (not shown) and has thereon a housing 5 rotatable around a substantially vertical axis. A rotation drive mechanism such as a motor, a rotational shaft, etc., (not shown) is built in the base 4.

Provided in the housing 5 are a light source A and a lamp tilting mechanism B with the front of the housing 5 being closed by a front glass plate 6 fitted into an inner peripheral groove in a ring-like front glass packing 7, which is held between a front frame 8 and a hold ring 9. The packing 7, front frame 8 and hold ring 9 are firmly secured together by a plurality of, for example three, equispaced screws 10 to the front periphery of the housing. An O-ring seal 11 is provided between the housing 5 and the front frame 8.

The light source A and the lamp tilting mechanism B are supported by a substantially U-like support frame 12, which is slidably inserted into a recess 13 formed in an inner surface of the housing 5 so as to extend from its front end toward its rear end, and fixed at the front end thereof by screws 14 to the hold ring 9. The support frame 12 will be described in more detail later.

The light source A includes the lamp 1, the socket 2, a socket holder 15, a reflector 16, the cover 17 and a ring-like reflector holder 18. The lamp 1 is inserted in and held by the socket 2, which is fixed within the socket holder 15. The reflector 16 is held between the inner periphery of the cover 17 (the right-hand portion in FIGS. 1 and 2 and the reflector holder 18. The reflector cover 17 is held at its inner periphery by a bent step 15*a* on the socket holder 15 and fixed at its outer periphery (left-hand portion in FIGS. 1 and 2) to the reflector holder 18, for example, by three equispaced screws 19. Threadedly fixed to the reflector holder 18 are a pair of opposing horizontal threaded pins 20 which are also received rotatably in the corresponding holes 21 in the branches 12*a*, 12*b* of the support plate 12. Therefore, the whole light source A is rotatable around the pins 20.

Formed at a rear end of the socket holder 15 is a tongue-like protrusion 22 in which a threaded pin 23 is threadedly fixed.

The pin 23, motor 3 and lever 24 constitute the lamp tilting mechanism B. The motor 3, which has built-in reduction gears, is fixed to a connection portion 12*c* of the support frame 12 by screws 26 through an L-like attachment plate 25. A lever 24 is fixed to a horizontal output shaft 27 of the motor 3 by a screw 28 so as not to make a relative rotation and has a slot 29 in which the pin 23 is loosely fitted. If the motor 3 is rotated, the rotational movement of the motor is decelerated by the reduction gears and transmitted though the output shaft 27 to the lever 24. Thus the lever 24 is rotated around the output shaft 27 to thereby move the pin 23 vertically in the slot 29. Therefore, the light source A is swung around the horizontal shafts 20 to thereby move vertically the light beams from the searchlight. When the lever 24 is swung to a maximum-elevation position or a maximum-dip position, it hits on a stop (not shown) and does not rotate any longer. At that time, the motor 3 is locked and does not rotate any longer. Reference numeral 30 denotes electric wires through which electric power is supplied from a power source (not shown) to the lamp 1 and motor 3.

Figure 3:
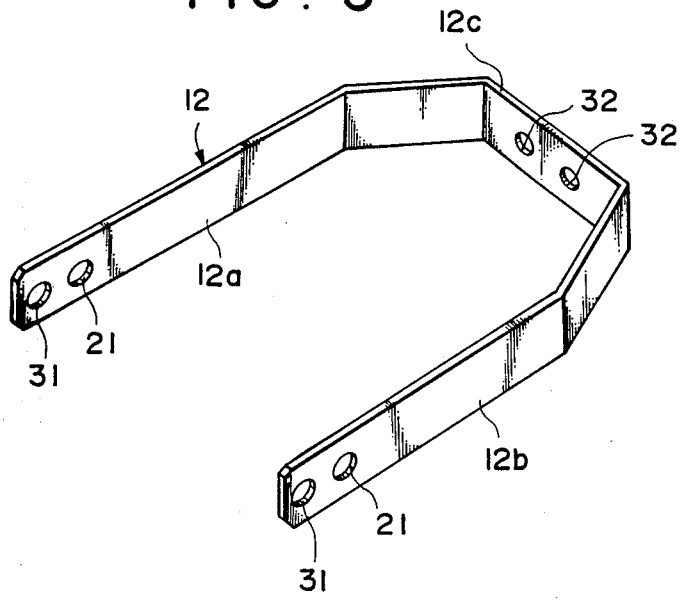
FIG. 3 is a perspective view of a support frame.
Figure 4:
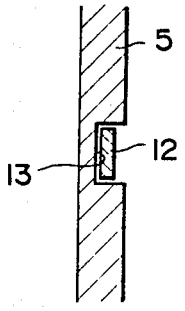
FIG. 4 is a cross section view of the support frame inserted in a guide in the housing.
Figure 5:
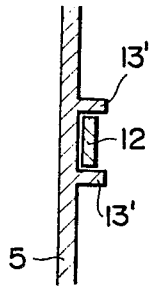
FIG. 5 is a modification of the guide.

As mentioned above, the light source A and the lamp tilting section B are supported by the support frame 12 within the housing 5. As shown in FIG. 3, the support frame 12 has the form of a substantially U, both branches 12*a* and 12*b* of which have holes 31 through which the screw 14 is inserted and holes 21 in which the pin 20 is supported rotatably, and a connection portion 12*c* of which connects the branches 12*a* and 12*b* and having holes 32 through which the screws 26 are inserted. The support frame 12 is slidably inserted in a guide 13 formed in the inner wall of the housing 5 and fixed at its front ends to the hold ring 9 by the screws 14. The guide 13 takes the form of a groove as shown in FIG. 4 extending from the front end of the housing 5 toward the rear thereof. The guide may be defined by a pair of elongated protrusions 13' as shown in FIG. 5.

In assembly, the light source A and the lamp tilting section B are attached beforehand to the support frame 12 outside the housing 5. The hold ring 9 is fixed by the screws 14 to the front end of the support frame 12. The assembly of support frame 12, light source A and lamp tilting section 8 is then inserted into the housing 5 along the guide 13 or 13' until the support frame 12 hits on the right-hand end 13*a* (FIG. 2) of the guide 13 or 13' on the inner surface of the housing 5 and fixed by the screws 10 to the housing 5 together with the hold ring 9, front glass packing 7, front glass plate 6 and front frame 8. Therefore, it is unnecessary to attach the respective parts in a small space within the housing 5. Thus the light source A and lamp tilting section 8 are very easy to assemble.

If the light source A and lamp tilting section B should be repaired, the assembly is taken out of the housing 5, disassembled and repaired. Therefore, even the parts positioned deep in the housing can be taken out of the housing and repaired easily.

While in the above embodiment the support frame 12 is fixed indirectly to the housing 5 (namely, through the hold ring 9), it may be directly fixed. Alternatively, the lamp tilting section B may take a form different from that in the embodiment.

As described above, in the inventive mounting mechanism, the assembly of the light source, the lamp tilting section and the support frame is removably inserted along the guide within and removably fixed to the housing. Therefore, the light source and searchlight tilting section are very easy to assemble and repair.

What is claimed:

1. A mechanism for mounting a light source which in turn includes a lamp, a reflector and a socket, and a lamp tilting section for swinging the light source vertically, within a housing of a searchlight including the light source and the lamp tilting section, comprising:

means slidingly insertable within the housing for supporting the light source and the tilting section, said supporting means including a substantially U-like support frame, the light source being supported swingably across the branches of the U-like support frame, and the lamp tilting section is fixed to a connection portion of the support frame which connects both the branches;

means formed in the inner surface of the housing for guiding the supporting means; and means for fixing the supporting means removably to a front opening end of the housing.

2. A mechanism according to claim 1, wherein the guiding means is a groove formed in the inner surface of the housing so as to extend from its front end toward its rear end, and the supporting frame is slidable in the groove.

3. A mechanism according to claim 1, wherein the guiding means includes a pair of elongated protrusions formed on the inner wall of the housing so as to extend from its front end toward its rear end, and the supporting frame is slidable between both the protrusions.

* * * * *